US005931714A

United States Patent [19]

Johnson

[11] Patent Number: 5,931,714

[45] Date of Patent: Aug. 3, 1999

[54] MAGNETIC TOY VEHICLE AND TRACK

[76] Inventor: Jeffery Todd Johnson, 9202 N. 19th Ave., Apt. 225, Phoenix, Ariz. 85021

[21] Appl. No.: 08/924,891

[22] Filed: Sep. 8, 1997

[51] Int. Cl.[6] ..... A63H 33/26; B60L 13/04

[52] U.S. Cl. ..... 446/129; 446/136; 104/281; 104/DIG. 1

[58] Field of Search ..... 446/129, 130, 446/133, 136, 429; 104/281, 283, 286, DIG. 1, 282; 335/306

[56] References Cited

U.S. PATENT DOCUMENTS

| | | | |
|---|---|---|---|
| 1,793,543 | 2/1931 | Chaplan | 446/438 |
| 2,002,358 | 5/1935 | Smith | 446/438 |
| 3,237,345 | 3/1966 | Feliziani | 446/130 X |
| 3,532,341 | 10/1970 | Shaw . | |
| 3,913,493 | 10/1975 | Maki et al. | 104/281 |
| 3,927,620 | 12/1975 | Clapham | 446/136 |
| 3,986,296 | 10/1976 | Hamano . | |
| 4,356,772 | 11/1982 | Van Der Heide | 104/283 X |
| 4,486,729 | 12/1984 | Lee | 446/133 X |
| 4,852,497 | 8/1989 | Tsui | 104/283 X |
| 4,990,117 | 2/1991 | Yonezawa . | |
| 5,152,528 | 10/1992 | Pascwalk . | |
| 5,165,347 | 11/1992 | Wagner | 446/129 X |
| 5,433,149 | 7/1995 | Kuznetzov | 104/286 X |
| 5,666,883 | 9/1997 | Kuznetsov | 104/281 |

FOREIGN PATENT DOCUMENTS

| | | | |
|---|---|---|---|
| 2099007 | 2/1972 | France | 46/129 |

*Primary Examiner*—D Neal Muir
*Attorney, Agent, or Firm*—David L. Volk

[57] ABSTRACT

A track comprises a base and two sidewalls. At least one toy vehicle comprises an underside and two sides. Magnets attached to the track and to the vehicle repel the underside of the vehicle from the base of the track, and repel the sides of the vehicle from the sidewalls of the track; thus, the vehicle floats above the base and between the sidewalls of the track. The vehicle moves along the track due to gravitational force applied to the vehicle, and alternatively due to motive force applied to the vehicle by a pair of rotating drums.

4 Claims, 4 Drawing Sheets

MAGNETIC TOY VEHICLE AND TRACK

BACKGROUND OF THE INVENTION

1. Field of the Invention

The present invention relates to toys, particularly to toy vehicles which move along tracks.

2. Description of the Related Art

Toy vehicles which move along tracks have long been popular among children and adults who are young at heart. One type of such toy applies the motive force to the vehicle via electrical current supplied through the track to the vehicle. Common electric toy trains and electric car racing sets work in such a manner.

A second type of such toy applies the motive force to the vehicle via gravity. The toy vehicle is released from a high portion of track and rolls along the track until the potential energy in the vehicle is dissipated by friction between the wheels of the vehicle and the track.

A third type of such toy provides motive force to the vehicle through a single rotating drum or a pair of rotating drums located in at least one position along the track.

One problem associated with all of the types of toy vehicles and tracks is that the wheels and axles will tend to attract foreign matter such as dust and grease. This will tend to hinder the rotation of the wheels, thus decreasing the speed at which the vehicles can travel along the track. Another problem is that the wheels are small and protrude from the vehicle, making them potentially harmful to very small children who may inadvertently separate the wheel from the vehicle and swallow the wheel.

SUMMARY OF THE INVENTION

The toy of the present invention includes a track having a base and two sidewalls. At least one toy vehicle comprises an underside and two sides. Magnets attached to the track and to the vehicle repel the underside of the vehicle from the base of the track, and repel the sides of the vehicle from the sidewalls of the track; thus, the vehicle floats above the base and between the sidewalls of the track. The vehicle moves along the track due to gravitational force applied to the vehicle, and alternatively due to motive force applied to the vehicle by a pair of rotating drums.

Because the magnets cause the vehicle to float above the base and between the sidewalls of the track, the vehicle moves along the track with less friction, allowing it to move at a greater speed for the same amount of motive force applied, compared to a vehicle with wheels.

Because there are no small wheels, the toy is less potentially harmful to small children. Additionally, the vehicle will be longer lasting and more reliable because there are no moving parts.

Still further features and advantages will become apparent from the ensuing description and drawings.

DETAILED DESCRIPTION

Figure 1:
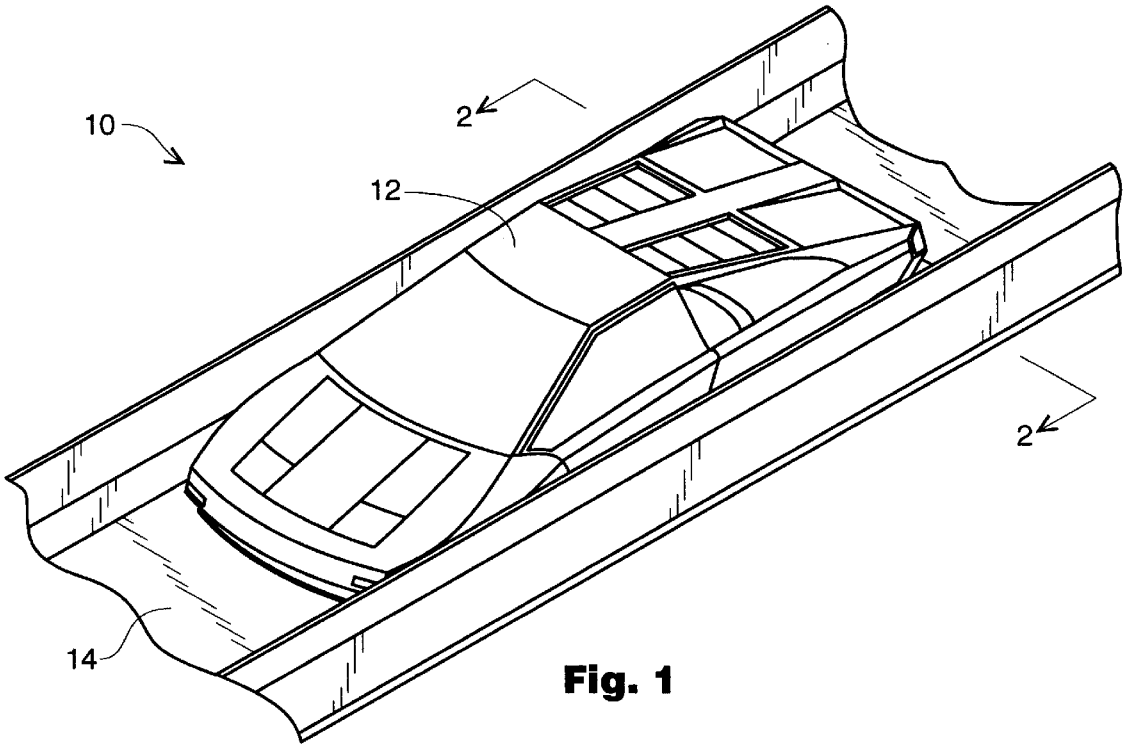
FIG. 1 is a perspective view of a toy of the present invention.

FIG. 1 is a perspective view of a toy 10 of the present invention. The toy 10 includes a toy vehicle 12 and a track 14. The track 14 includes a base 14A and two sidewalls 14B. The vehicle 12 is configured to move along the track 14 above the base 14A and between the two sidewalls 14B.

Figure 2:
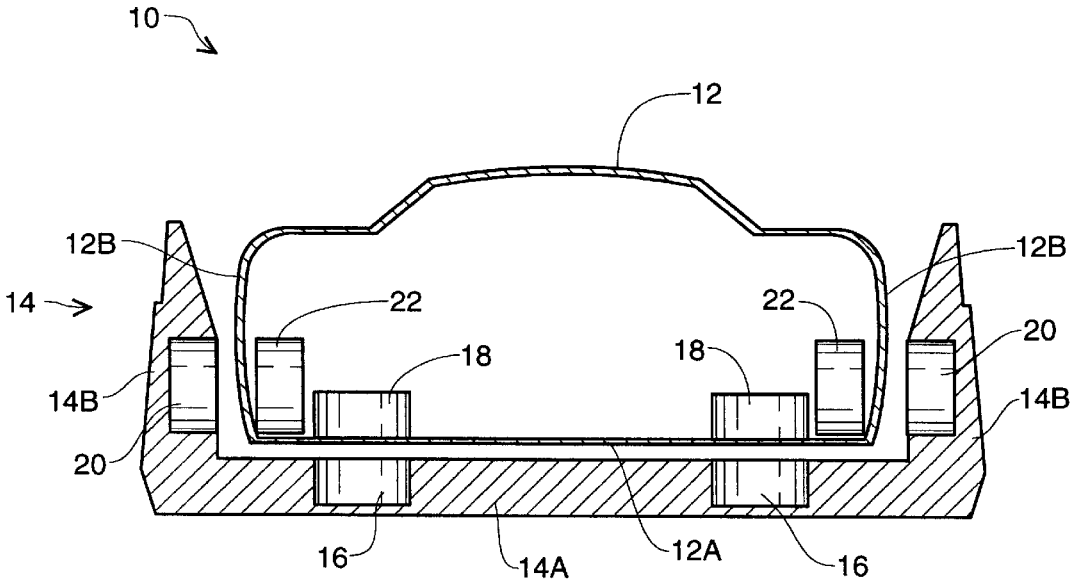
FIG. 2 is a cross-sectional view taken along line 2—2 of FIG. 1, showing a first embodiment of the toy vehicle, and a first embodiment of the track.
Figure 3:
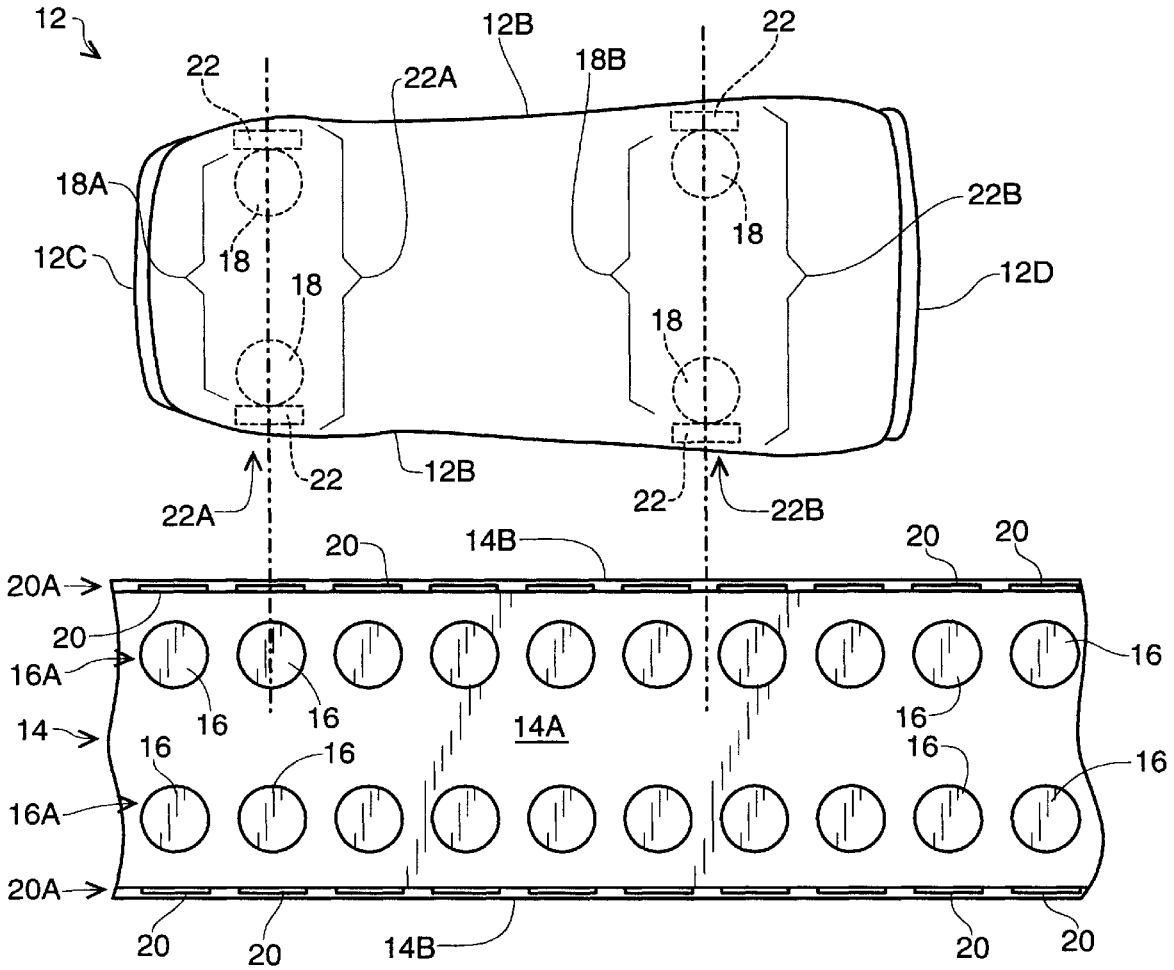
FIG. 3 is a top plan view of the first embodiment of the vehicle and a top plan view of the first embodiment of the track.

FIG. 2 is a cross-sectional view taken along line 2—2 of FIG. 1, showing a first embodiment of the toy vehicle 12, and a first embodiment of the track 14. FIG. 3 is a top plan view of the first embodiment of the vehicle 12 and a top plan view of the first embodiment of the track 14. Referring to FIGS. 2 and 3, the base 14A of the track includes two series 16A of first magnets 16 disposed longitudinally along the track 14 near the sidewalls 14B. The two series 16A of first magnets 16 are disposed parallel to each other. The first magnets 16 are evenly spaced within each series 16A.

The vehicle 12 includes an underside 12A and two sides 12B. A first pair 18A of second magnets 18 is disposed on the underside 12A of the vehicle 12 near a front 12C of the vehicle 12. A second pair 18B of second magnets 18 is disposed on the underside 12A of the vehicle 12 near a rear 12D of the vehicle 12. As shown in FIG. 3, each of the second pair 18B of the second magnets 18 aligns directly over a gap between the first magnets 16 when each of the first pair 18A of the second magnets 18 aligns directly over one of the first magnets 16. When the second magnets 18 are aligned with the first magnets 16 in such a manner, this ensures that the overall repelling force between the track 14 and the vehicle 12 remains relatively constant as the vehicle 12 moves along the track 14.

A series 20A of third magnets 20 aligns each of the sidewalls 14B of the track 14. Each of the third magnets 20 is aligned with one of the first magnets 16. A first pair 22A of fourth magnets 22 is disposed adjacent the sides 12B of the vehicle 12, and aligned with the first pair 18A of second magnets 18. A second pair 22B of fourth magnets 22 is disposed adjacent the sides 12B of the vehicle 12, and aligned with the second pair 18B of the second magnets 18.

When the vehicle 12 and the track 14 are configured as shown and described in FIGS. 2–3, the sides 12B of the vehicle 12 are repelled from the sidewalls 14B of the track 14, and the underside 12A of the vehicle 12 is repelled from the base 14A of the track 14; thus, the vehicle 12 floats above the base 14A and between the sidewalls 14B of the track 14.

It is possible to modify the present invention to delete the fourth magnets 22 from the sides 12B of the vehicle 12. In such a case, the vehicle 12 could potentially touch the sidewalls 14B of the track 14 as the vehicle 12 moves along the track 14.

Figure 4:
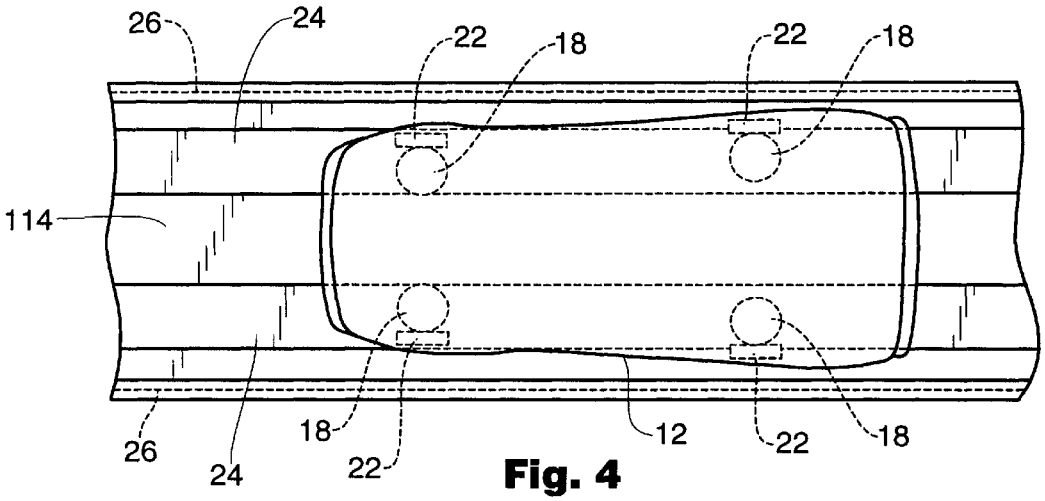
FIG. 4 is a top plan view of the first embodiment of the vehicle and a second embodiment of the track.

FIG. 4 is a top plan view of the first embodiment of the vehicle 12 and a second embodiment of the track 114, wherein the first magnets 16 are replaced by two, parallel, longitudinally disposed first magnetic strips 24, and the third magnets 20 are replaced by longitudinally disposed third magnetic strips 26. The first magnetic strips 24 repel the second magnets 18, and the third magnetic strips 26 repel the fourth magnets 22.

Figure 5:
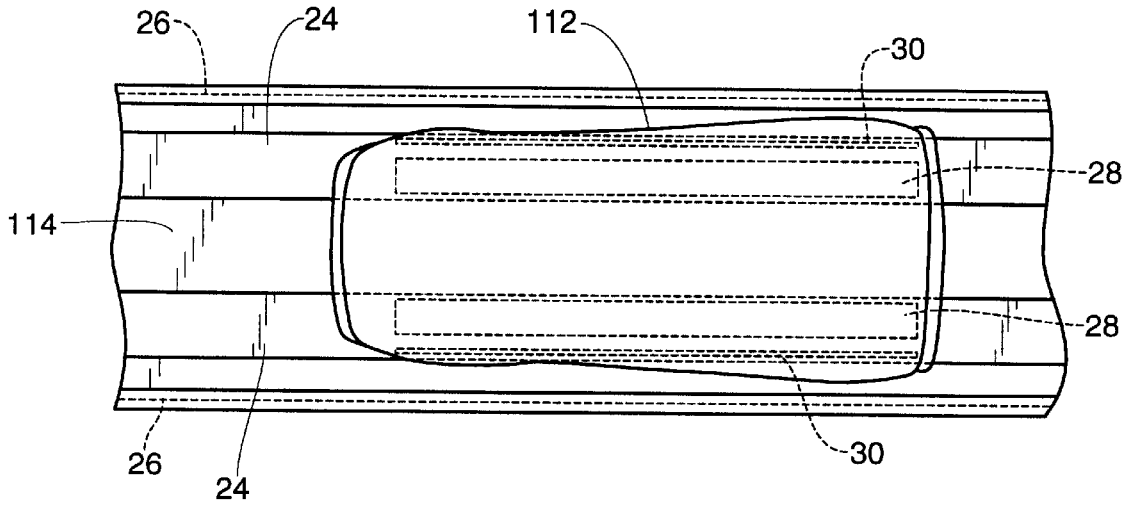
FIG. 5 is a top plan view of a second embodiment of the vehicle and the second embodiment of the track.

FIG. 5 is a top plan view of a second embodiment of the vehicle 112 and the second embodiment of the track 114. The second magnets 18 are replaced by two, parallel longitudinally disposed second magnetic strips 28, and the fourth magnets 22 are replaced by longitudinally disposed fourth magnetic strips 30. The first magnetic strips 24 repel the second magnetic strips 28, and the third magnetic strips 26 repel the fourth magnetic strips 30.

Figure 6:
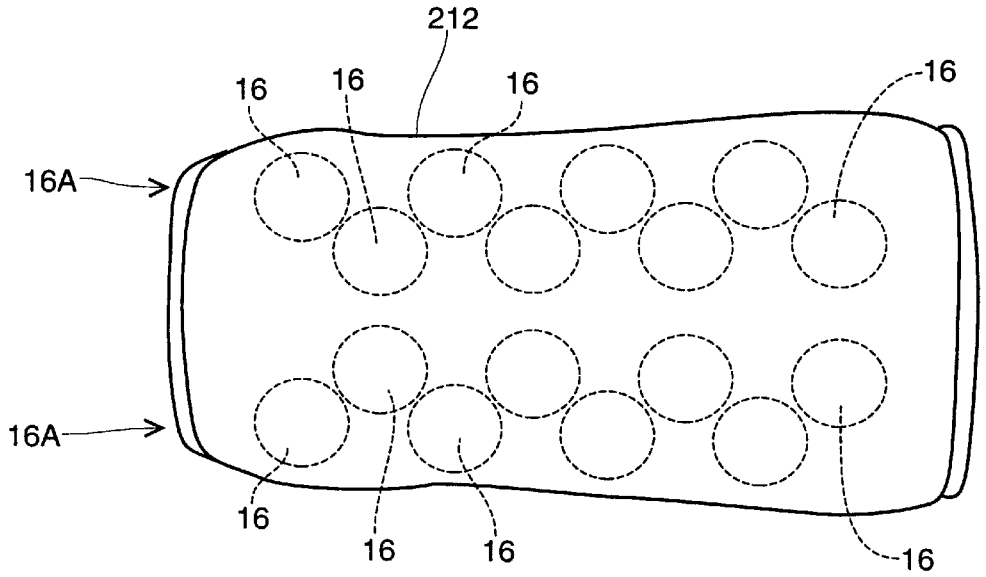
FIG. 6 is a bottom plan view of a third embodiment of the vehicle.

FIG. 6 is a bottom plan view of a third embodiment of the vehicle 212. The two series 16A of the first magnets 16 in this embodiment are each arranged in a zig-zag pattern. This arrangement provides more consistent total repelling force between the track 14 and the vehicle 212 than the first embodiment shown in FIGS. 2 and 3.

Figure 7:
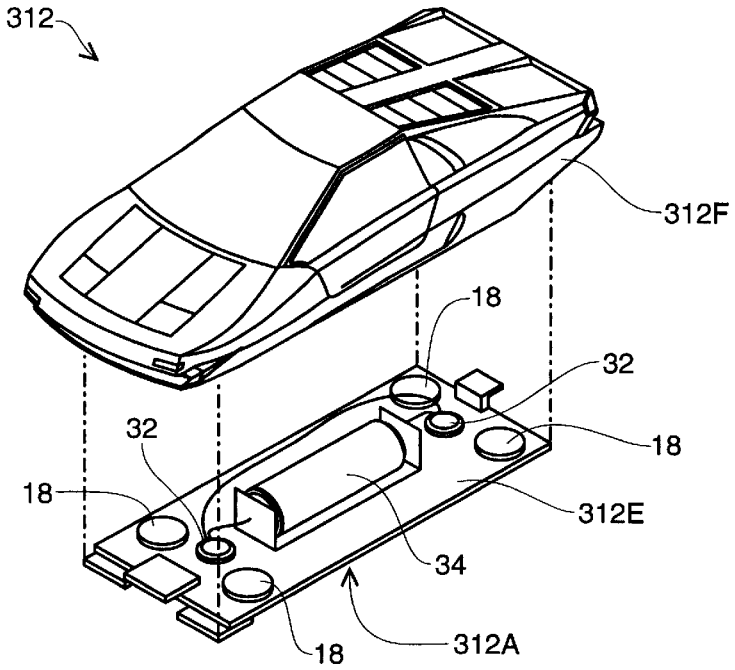
FIG. 7 is an exploded perspective view of a fourth embodiment of the vehicle.

FIG. 7 is an exploded perspective view of a fourth embodiment of the vehicle 312. In this embodiment, light emitting diodes 32 powered by a battery 34 shine downward from the underside 312A of the vehicle 312 to illuminate the track 14. This illumination provides an exciting and pleasing visual effect. A chassis 312E of the vehicle 12 is easily removably connectable to a body 312F of the vehicle 312, to permit changing of the diodes 32 and the battery 34.

Figure 8:
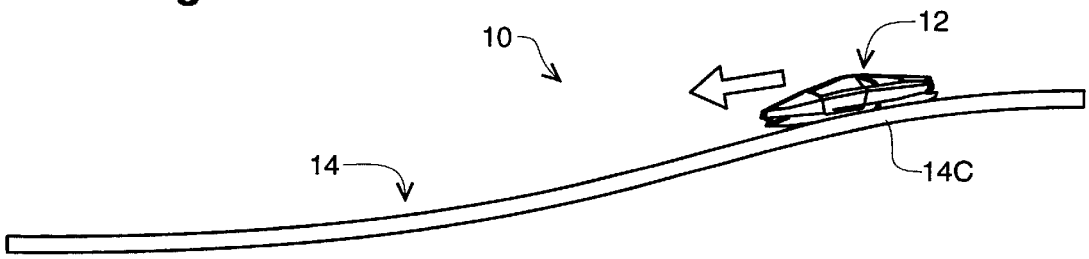
FIG. 8 is an elevational view of the toy, showing how the vehicle moves along the track due to the action of gravitational force upon the vehicle.

FIG. 8 is an elevational view of the toy 10, showing how the vehicle 12 moves along the track 14 due to the action of gravitational force upon the vehicle 12. This is accomplished by releasing the vehicle 12 from a raised portion 14C of the track 14.

Figure 9:
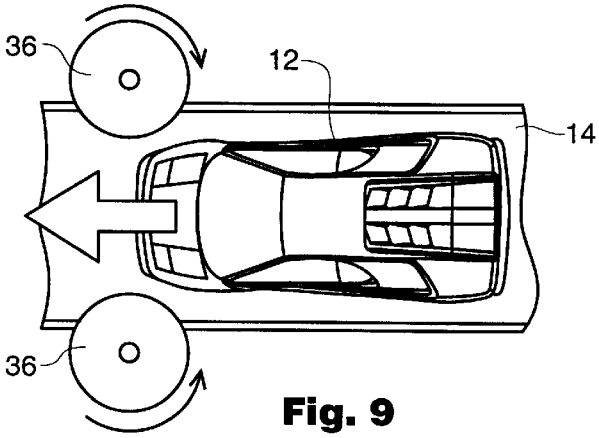
FIG. 9 is a top plan view of the toy, showing how motive force is applied to the vehicle by rotating drums.

FIG. 9 is a top plan view of the toy 10, showing how motive force may be applied to the vehicle 12 by rotating drums 36. The drums 36 are powered by batteries (not shown). The vehicle 12 is caught between the drums 36 and shot forward by the motion of the drums 36, enough force being applied for the vehicle 12 to return to the drums 36, to again be caught between the drums 36 and shot forward.

Both methods of providing motive force to the vehicle 12 as shown and described in FIGS. 8 and 9 are already known. Other methods would be within the scope of the present invention, such as electrical power provided through the track 14 to the vehicle 12 as is known for common electric trains and electric racing sets, and other known means.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. By way of example and not limitation, various other arrangements of magnets in the track and in the vehicle are possible. Furthermore, the magnets could be buried within the track beneath a layer of plastic, such that they are not visible. Accordingly, the scope of the invention is to be limited only by the following claims and their legal equivalents.

The invention claimed is:

1. A toy comprising:

a. a track comprising a first magnet means attached thereto;

b. at least one vehicle comprising a second magnet means attached thereto;

c. the first magnet means configured to repel the second magnet means such that the vehicle floats above the track;

d. the first magnet means comprising at least two series of first magnets, each of the series of first magnets disposed longitudinally along the track, the at least two series of first magnets disposed in generally parallel relationship to each other; and e. the second magnet means comprising:

i. a first pair of second magnets disposed on an underside of the vehicle near a front end of the vehicle and arrange such that a geometric line passing through centers of each of the second magnets of the first pair of second magnets is perpendicular to a longitudinal axis of the vehicle;

ii. a second pair of second disposed on the underside of the vehicle near a rear end of the vehicle and arrange such that a geometric line passing through centers of each of the second magnets of the second pair of second magnets is perpendicular to the longitudinal axis of the vehicle;

iii. the underside of the vehicle being devoid of magnets between the first and second pairs of second magnets; and iv. the first pair of second magnets and the second pair of second magnets configured such that each of the second pair of second magnets aligns directly over a gap between the first magnets when each of the first pair of second magnets aligns directly over one of the first magnets.

2. The toy of claim 1, wherein the vehicle is configured to move along the track while floating above the track, due to gravitational force applied to the vehicle.

3. The toy of claim 1, wherein the vehicle is configured to move along the track while floating above the track, due to motive force applied to the vehicle by at least one rotating drum.

4. The toy of claim 1, wherein the vehicle includes an illuminating means for illuminating an underside of the vehicle.

* * * * *